US006784559B1

(12) United States Patent
Simonds

(10) Patent No.: US 6,784,559 B1
(45) Date of Patent: Aug. 31, 2004

(54) FLUID PRESSURE REGULATOR ASSEMBLY WITH DUAL AXIS ELECTRICAL GENERATOR

(75) Inventor: Edward L. Simonds, Adel, IA (US)

(73) Assignee: Thermal Dynamics, Inc., Adel, IA (US)

( * ) Notice: Subject to any disclaimer, the term of this patent is extended or adjusted under 35 U.S.C. 154(b) by 80 days.

(21) Appl. No.: 10/085,969

(22) Filed: Feb. 28, 2002

(51) Int. Cl.[7] ..... A63B 31/00; B63C 11/46; B63B 21/56

(52) U.S. Cl. ..... 290/1 R; 114/315

(58) Field of Search ..... 290/1 R; 114/315

(56) References Cited

U.S. PATENT DOCUMENTS

| | | | | | |
|---|---|---|---|---|---|
| 1,115,470 | A | | 10/1914 | Lipman | 91/180 |
| 1,492,456 | A | | 4/1924 | Hansen-Ellehammer | 418/260 |
| 2,636,480 | A | | 4/1953 | Becker | 418/81 |
| 2,671,411 | A | | 3/1954 | Rhine | 418/254 |
| 3,066,638 | A | * | 12/1962 | Andersen, Jr. | 440/5 |
| 3,084,654 | A | * | 4/1963 | Rosemberg et al. | 114/315 |
| 3,128,739 | A | * | 4/1964 | Schultz | 440/49 |
| 3,411,474 | A | * | 11/1968 | Curtis | 114/315 |
| 3,415,211 | A | * | 12/1968 | Hampton | 114/315 |
| 3,702,938 | A | * | 11/1972 | Garnier | 290/52 |
| 3,789,788 | A | * | 2/1974 | Peroni | 114/315 |
| 3,804,562 | A | | 4/1974 | Hansson | 418/107 |
| 3,938,426 | A | | 2/1976 | Hunter | 92/140 |
| 3,957,007 | A | * | 5/1976 | Thomas | 114/315 |
| 3,988,083 | A | | 10/1976 | Shimizu et al. | 72/81 |
| 4,077,422 | A | * | 3/1978 | Brinkley et al. | 137/68.14 |
| 4,385,873 | A | * | 5/1983 | Richter | 418/23 |
| 4,531,898 | A | * | 7/1985 | Ideta | 418/26 |
| 4,632,638 | A | * | 12/1986 | Shibayama et al. | 417/218 |
| 4,669,951 | A | * | 6/1987 | Stern | 415/90 |
| 4,712,789 | A | | 12/1987 | Brilando | 272/73 |
| 4,732,537 | A | * | 3/1988 | Kusz et al. | 415/205 |
| 4,757,988 | A | | 7/1988 | Szymski | 272/73 |
| 4,789,317 | A | | 12/1988 | Waser et al. | 418/189 |
| 4,898,524 | A | | 2/1990 | Butzen | 418/136 |
| 4,902,001 | A | | 2/1990 | Balbo | 272/73 |
| 4,986,402 | A | | 1/1991 | Neuwirth et al. | 192/45 |
| 4,998,868 | A | | 3/1991 | Sakamaki et al. | 418/257 |
| 5,002,473 | A | | 3/1991 | Sakamaki et al. | 418/257 |
| 5,011,390 | A | | 4/1991 | Sakamaki et al. | 418/256 |
| 5,030,074 | A | | 7/1991 | Sakamaki et al. | 418/256 |
| 5,284,427 | A | | 2/1994 | Wacker | 418/83 |
| 5,461,863 | A | | 10/1995 | Simonds | 60/676 |
| 5,533,566 | A | | 7/1996 | Fineblum | 165/1 |
| 5,551,854 | A | | 9/1996 | Edwards | 418/265 |
| 5,617,936 | A | | 4/1997 | Nemoto | 192/4 A |
| 5,690,100 | A | * | 11/1997 | Pomerantz | 128/205.24 |
| 5,816,789 | A | | 10/1998 | Johnson | 418/227 |
| 5,961,310 | A | | 10/1999 | McClure | 418/248 |
| 5,967,016 | A | | 10/1999 | Simonds | 91/180 |
| 5,974,943 | A | | 11/1999 | Simonds | 91/180 |
| 6,024,549 | A | | 2/2000 | Lee | 418/135 |
| 6,203,041 | B1 | | 3/2001 | Helm | 280/250.1 |
| 6,412,280 | B1 | * | 7/2002 | Simonds | 60/643 |
| 6,616,433 | B1 | * | 9/2003 | Simonds | 418/265 |

FOREIGN PATENT DOCUMENTS

| | | |
|---|---|---|
| DE | 2029 280 | 6/1970 |
| GB | 392999 | 6/1933 |
| JP | 61-83492 A | 9/1984 |
| WO | WO 82/01215 | 4/1982 |

* cited by examiner

*Primary Examiner*—Burton S. Mullins
*Assistant Examiner*—Pedro J. Cuevas
(74) *Attorney, Agent, or Firm*—Brett Trout

(57) ABSTRACT

A fluid pressure regulator assembly is provided for generating power from a pressurized fluid. A vane motor is coupled between a high-pressure fluid source and a regulator, to extract power from the pressurized fluid and reduce the burden on the fluid regulator. The assembly may be used in association with many devices, including gas grills and self-contained underwater breathing apparatuses. A plurality of vane motors may be provided and generators may be coupled thereto for producing electricity from the pressurized fluid.

20 Claims, 3 Drawing Sheets

FLUID PRESSURE REGULATOR ASSEMBLY WITH DUAL AXIS ELECTRICAL GENERATOR

BACKGROUND OF THE INVENTION

1. Field of the Invention

The present invention relates in general to a fluid pressure regulator assembly and, more particularly, to a fluid pressure generator assembly, which produces energy from fluid pressure regulation.

2. Description of the Prior Art

Fluid pressure regulators are well known in the art. Regulators are used to regulate the pressure of liquid propane in an outdoor gas grill, airflow in self-contained underwater breathing apparatuses, and oxygen flow in medical applications. Regulators may be designed for regulating the pressure of virtually any type of fluid. One drawback associated with prior art fluid pressure regulators is the loss of energy between the high-pressure fluid entering the regulator and the low-pressure fluid exiting the regulator. It would be desirable to convert this potential energy into work. Another drawback with prior art systems is that a large reduction in pressure typically requires a more costly regulator. It would, therefore, be desirable to provide an assembly which reduces pressure before reaching a prior art regulator, to allow a more inexpensive regulator to be used. Additionally, single stage regulators often do an inadequate job of modulating large variances in pressure. Accordingly, it would be desirable to find a fluid pressure regulator which reduced the effects of large pressure variances on a fluid output pressure. The difficulties encountered in the prior art discussed herein are substantially eliminated by the present invention.

SUMMARY OF THE INVENTION

In an advantage provided by this invention, a fluid pressure regulator assembly is provided for generating power while regulating a fluid pressure.

Advantageously, this invention provides a fluid pressure regulator assembly for reducing variances in an output pressure as the result of large differences in input pressure.

Advantageously, this invention provides a fluid pressure regulator assembly which is inexpensive to manufacture and maintain.

Advantageously, this invention provides a fluid pressure regulator assembly which is lightweight and portable.

Advantageously, this invention provides a fluid pressure regulator assembly which reduces the size and cost of a regulator needed to regulate the pressure of a fluid.

Advantageously, in a preferred example of this invention, a fluid pressure regulator assembly is provided, comprising means for providing a pressurized fluid, as well as first means and second means for transporting a pressurized fluid. A fluid regulator is coupled to both the first means and second means, and means are coupled between the first means and the fluid regulator for converting a pressurized fluid into mechanical power.

In a preferred embodiment of the present invention, the converting means is a vane pump, coupled into fluid communication with the first means for converting pressurized fluid into movement of the vanes. The movement of the vanes may, thereafter, be converted into rotational and/or electrical energy.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
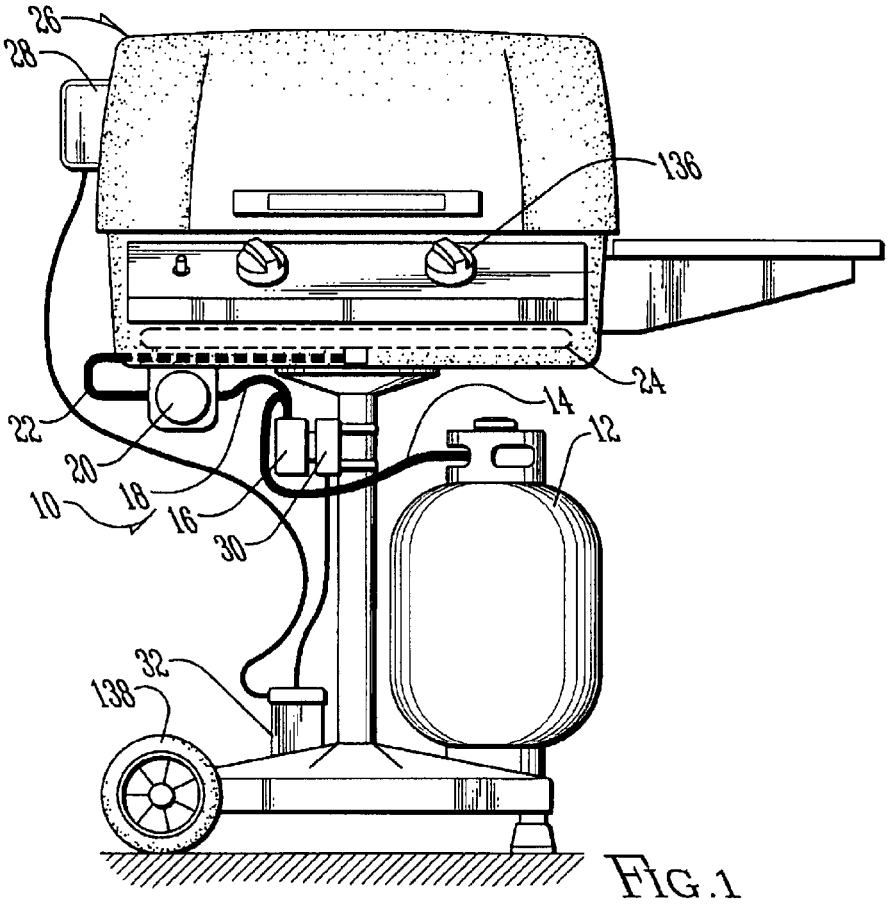
FIG. 1 illustrates a front elevation of a gas grill, utilizing the fluid pressure regulator of the present invention.

A fluid pressure regulator assembly is shown generally as (10) in FIG. 1. The assembly (10) comprises a pressurized fluid source, such as a liquid propane tank (12), such as those well known in the art. Coupled to the compressor is a high-pressure line (14) which, in turn, is coupled to a vane motor (16). The vane motor (16) is coupled by a transfer line (18) to a fluid regulator (20). The fluid regulator (20) is coupled to an output line (22) which, in turn, is coupled to the burner (24) of a gas grill (26). The grill (26) may be provided with an electrically actuated rotisserie (28), or any other desired components. As shown in FIG. 1, coupled to the vane motor (16) is a generator (30), which is electrically coupled to a battery (32) which, in turn, is coupled to the rotisserie (28). The liquid propane tank (12), high-pressure line (14), fluid regulator (20), output line (22), burner (24), gas grill (26), and rotisserie (28) may be of any type, such as those well known in the art.

Figure 2:
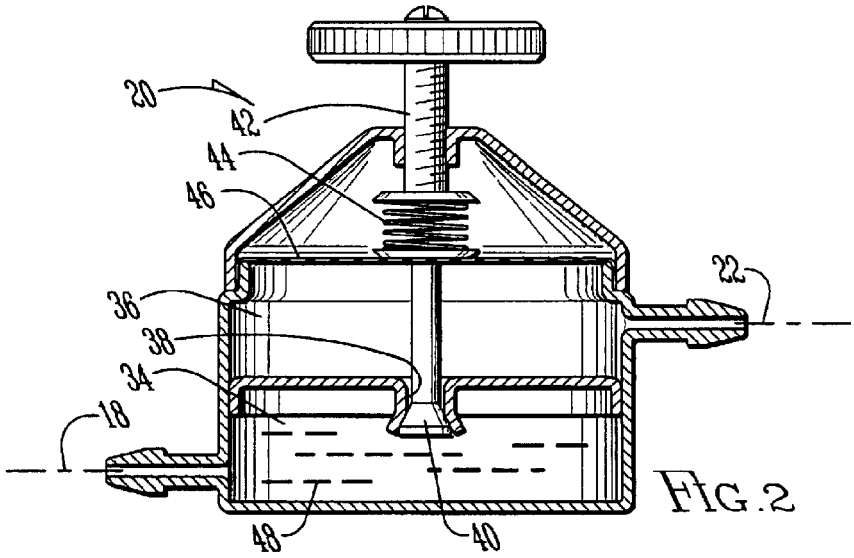
FIG. 2 illustrates a top elevation in cross-section of the pressure regulator of FIG. 1.

As shown in FIG. 2, the fluid regulator (20) is preferably of the type known in the art, constructed of steel, defining a high-pressure cavity (34) in fluid communication with a low-pressure cavity (36). The high-pressure cavity (34) is coupled to the transfer line (18), while the low-pressure cavity (36) is coupled to the output line (22). The cavities (34) and (36) are provided in fluid communication with one another via an opening (38). Provided through the opening (38) is a valve stem (40), designed to completely seal off fluid communication between the high-pressure cavity (34) and low-pressure cavity (36), when seated in the opening (38). Coupled to the valve stem (40) is a threaded shaft (42), around which is provided a compressed spring (44), coupled to a resilient diaphragm (46). At ambient pressure, the spring (44) presses the valve stem (40) downward, opening communication between the high-pressure cavity (34) and low-pressure cavity (36). When a fluid (48), such as liquid propane, enters the high-pressure cavity (34), the fluid (48) moves into the low-pressure cavity (36) through the opening (38). As the fluid (48) fills the low-pressure cavity (36), pressure increases, thereby moving the diaphragm (46) to lift the valve stem (40) to begin to close the opening (38). The valve stem (40) continues to move until the flow of fluid (48) across the opening (38) is reduced when the compressed spring (44) overcomes the upward pressure on the diaphragm (46), the valve stem (40) lowers and increases the flow of fluid (48) from the high-pressure cavity (34) to the low-pressure cavity (36). In this manner, the spring (44) and diaphragm (46) continually act to regulate the pressure within the low pressure cavity (36) and exiting through the output line (22), as long as the pressure in the high pressure cavity (34) remains as least as high as the pre-determined pressure for which the spring (44) and diaphragm (46) are set. Although the foregoing describes the regulator utilized in the preferred embodiment of the present invention, any regulator, such as the air regulator on a scuba system, or fluid regulator on a welding assembly, may be utilize.

Figure 3:
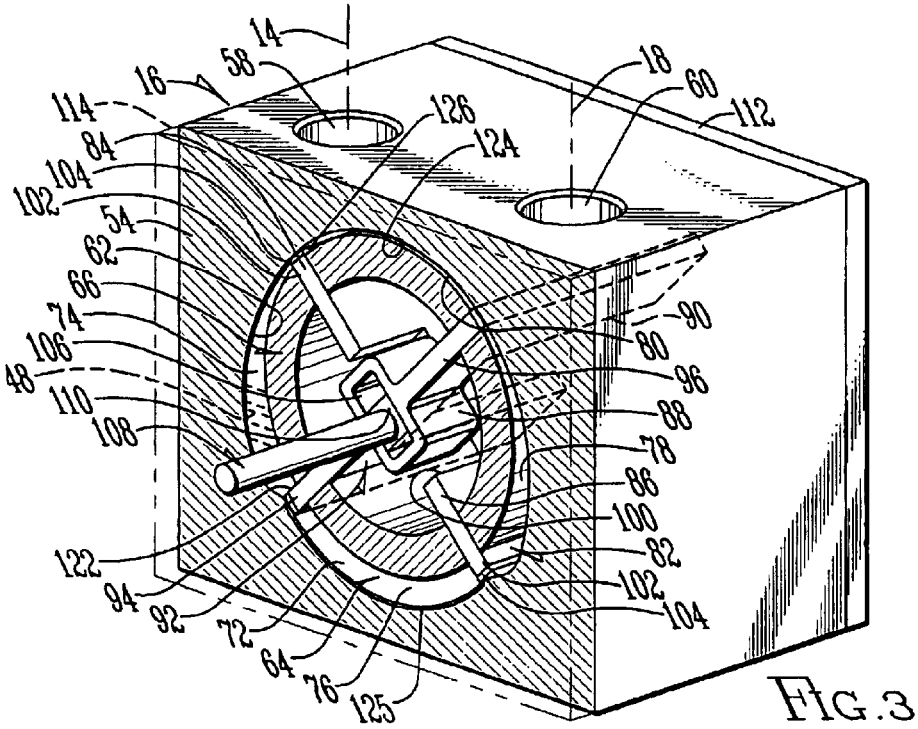
FIG. 3 illustrates a perspective view of the vane motor of the pressure regulator of FIG. 1.
Figure 4:
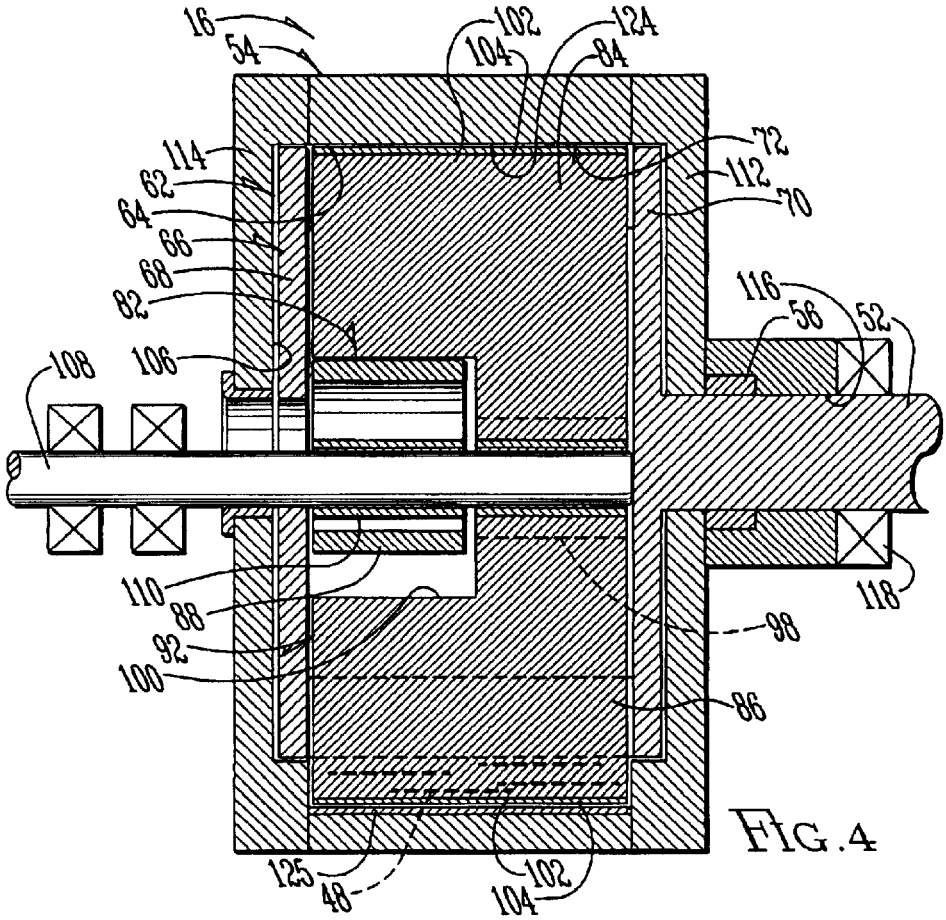
FIG. 4 illustrates a side elevation in cross-section of the vane motor of FIG. 3.

As shown in FIG. 3, the motor (16) is preferably a vane motor, although it may be any suitable device for translating fluid pressure into mechanical motion. Preferably, as shown in FIGS. 3 and 4, the motor (16) is provided with a drive shaft (52), coupled to a casing (54) by a bushing (54). The casing (54) defines a fluid inlet (58) and a fluid outlet (60). In the preferred embodiment, the fluid inlet (58) is coupled into fluid communication with the high-pressure line (14). (FIGS. 1–3). The casing (54) is provided with a hollow interior (62) in fluid communication with the inlet (58) and outlet (60). The hollow interior (62) is defined by an outer race (64). Provided within the hollow interior (62) is an inner drum (66), which comprises a front plate (68), a back plate (70), and a cylindrical inner race (72). (FIGS. 2 and 3). As shown in FIG. 3, the inner race (72) is provided with a first aperture (74), a second aperture (76), a third aperture (78), and a fourth aperture (80).

Provided within the inner drum (66) is a first vane assembly (82), which includes a first vane (84) and a third vane (86), each secured to a lost motion linkage (88). The first vane (84) and third vane (86) are wider than the first lost motion linkage (88), leaving a first C-shaped cutout (90) in the first vane assembly (82). A second vane assembly (92) is also provided, comprising a second vane (94), a fourth vane (96) and a second lost motion linkage (98). The second vane (94) and fourth vane (96) are secured to the second lost motion linkage (98) in a manner similar to that described above to provide a second C-shaped cutout (100).

The first vane assembly (82) and second vane assembly (92) are constructed in a manner which positions the first vane (84) and third vane (86) perpendicular to the second vane (94) and fourth vane (96). The first lost motion linkage (88) is provided within the second C-shaped cutout (100) of the second vane assembly (92), and the second lost motion linkage (98) is provided within the first C-shaped cutout (90) of the first vane assembly (82). Preferably, the vane assemblies (82) and (92) are constructed of stainless steel and are provided near their ends (102) with wear resistant tips (104), constructed of an aluminum nickel bronze alloy, such as those alloys well known in the art to be of superior wear resistance. The tips (104) are rounded with a tighter radius of curvature than the outer race (64). The tips (104) are secured to the vane assemblies (82) and (92) by weldments or similar securement means. The first lost motion linkage (88) defines an interior space (106) with a width approximately one-half of its length. Provided within this interior space (106) is a stainless steel drum shaft (108). Secured around the drum shaft (108) is a guide block (110). The guide block (110) has a square cross-section with a width only slightly smaller than the width of the interior space (106), defined by the first lost motion linkage (88). The guide block (110) is preferably the same depth as the vanes (84), (86), (94) and (96), and extends from the interior space (106) of the first lost motion linkage (88) into an interior space (not shown) defined by the second lost motion linkage (98). This construction allows longitudinal movement of the vane assemblies (82) and (92) relative to the guide block (110) and drum shaft (108), but prevents lateral movement in relationship thereto.

The drum shaft (108) is coupled to a back plate (112) bolted to the casing (54). FIGS. 2 and 3). As shown in FIG. 4, the drum shaft (108) is centered within the hollow interior (62) defined by the outer race (64). The drive shaft (52) is positioned slightly higher than the drum shaft (108), and is coupled to a front plate (114) bolted to the casing (54). The drive shaft (52) is parallel to, but on a different axis than the drum shaft (108). Since the shafts (52) and (108) each rotate on a different axis, the back plate (112) must be provided with a large, circular aperture (116), into which is secured a bearing (118). The bearing (118) supports the inner drum (66) against the casing (54) and allows the drum shaft (108) to extend out of the casing (54) and rotate on its own axis. The bearing (118) also maintains a substantially fluid tight seal to prevent the escape of pressurized fluid out of the casing (54).

As fluid (48) enters the fluid inlet (58) under pressure, the water presses against a face (122) of the second vane (94), forcing the inner drum (66) into a counterclockwise rotation. (FIG. 3). When the fourth vane (96) is closest to a ceiling (124) of the casing (54), the majority of the fourth vane (96) is located within the inner drum (66). Accordingly, the amount of the fourth vane (96) exposed to the fluid (48) is reduced, as is its drag coefficient. A larger drag coefficient would allow the fluid (48) to force the inner drum (66) toward a clockwise rotation, thereby reducing the efficiency of the motor (16).

As the fluid (48) presses against the face (114) of the second vane (94), the second vane (94) moves along an abrasion plate (125), preferably constructed of titanium or similar abrasion resistant material, preferably being less than five millimeters and, more preferably, less than one millimeter, while being preferably greater than 1/100th of a millimeter and, more preferably, more than 1/50th of a millimeter from the tips (104) of the vanes (84), (86), (94) and (96) as they rotate past. As the second vane (94) rotates toward the end of the abrasion plate (125), the first vane (84) moves toward the abrasion plate (125) and the fluid (48) presses against a face (126) of the first vane (84), thereby continuing the counterclockwise rotation of the drum shaft (108) and the inner drum (66). As the inner drum (66) continues to rotate, the vanes (84), (86), (94) and (96) extend and retract relative to the inner drum (66). The retraction reduces the drag coefficient of the vanes (84), (86), (94) and (96) when the vanes are near the ceiling (124) to reduce reverse torque on the inner drum (66). Conversely, the extension increases the drag coefficient of the vanes (84), (86), (94) and (96) as the vanes approach the abrasion plate (125) to allow the fluid (48) to provide maximum forward torque to the inner drum (66) through the vanes (84), (86), (94) and (96). As the vanes (84), (86), (94) and (96) move past the abrasion plate (125), the fluid (48) exhausts through the fluid outlet (60). Obviously, the motor (16) can be constructed of any desired material of any suitable dimensions.

As shown in FIG. 1, coupled to the drive shaft (52) of the motor (16) is an electrical generator (30). While the generator (30) is preferably electric, it may, of course, be of any suitable type of power storage or transmission device known in the art, actuated by heat, mechanical, pneumatic or hydraulic power. As shown in FIG. 1, an electrical cord is coupled to the generator (30), and is coupled to a battery (134). The battery, in turn, is coupled to the rotisserie (28) to provide power when needed. Accordingly, when a valve (136) on the gas grill (26) is actuated to draw fluid from the liquid propane tank (12), the fluid (48) flows from the liquid propane tank (12) through the high-pressure line (14) into the vane motor (16). The pressure of the fluid (48) turns the vanes (84), (86), (94) and (96), thereby driving the drive shaft (52) and the generator (30). The generator (30) thereby sends an electric current to the battery (32) for use in driving the rotisserie (28) when desired. From the vane motor (16), the fluid (48) having been reduced in pressure, flows through the transfer line (18) to the fluid regulator (20), whereby after a further step-down in pressure, the fluid (48) flows through the output line (28) to the burner (24) for use in the grill (26). Although in the preferred embodiment the vane motor (16) is used to generate electricity to drive the rotisserie (28), the vane motor (16) may, of course, be used to generate electricity for any desired function, or used directly for mechanical power to drive the rotisserie (28) wheels (138) provided on the gas grill (26), or for any other desired utility.

Figure 5:
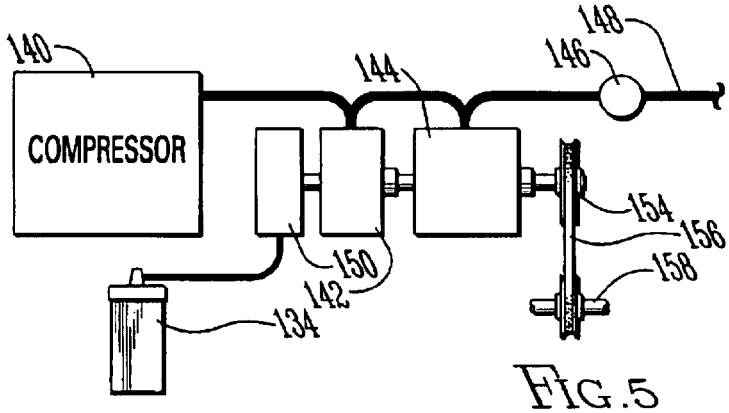
FIG. 5 illustrates a side elevation of an alternative embodiment of the present invention, utilizing dual vane motors.

In an alternative embodiment of the present invention, as shown in FIG. 5, a high pressure fluid source such as a compressor (140) is coupled to a first vane motor (142) which, in turn, is coupled to a second vane motor (144). The second vane motor (144) is coupled to a regulator (146), such as that described above, and an output line (148) is also coupled to the regulator (146). As shown in FIG. 5, the first vane motor (142) is coupled to a generator (150) which, in turn,is coupled to a battery (152). The second vane motor (144) is coupled to a pulley (154) which, in turn, is coupled to a belt (156), used to drive an axle (158). Although one vane motor (142) is used in this embodiment to produce electricity, and the other vane motor (144) is used to produce mechanical work, any number of vane motors may be utilized to produce electricity, and any other number of vane motors may be used to produce mechanical work, if desired. Such an assembly would be particularly well suited to a vehicle driven by a pressurized flammable fluid, such as liquid propane.

Figure 6:
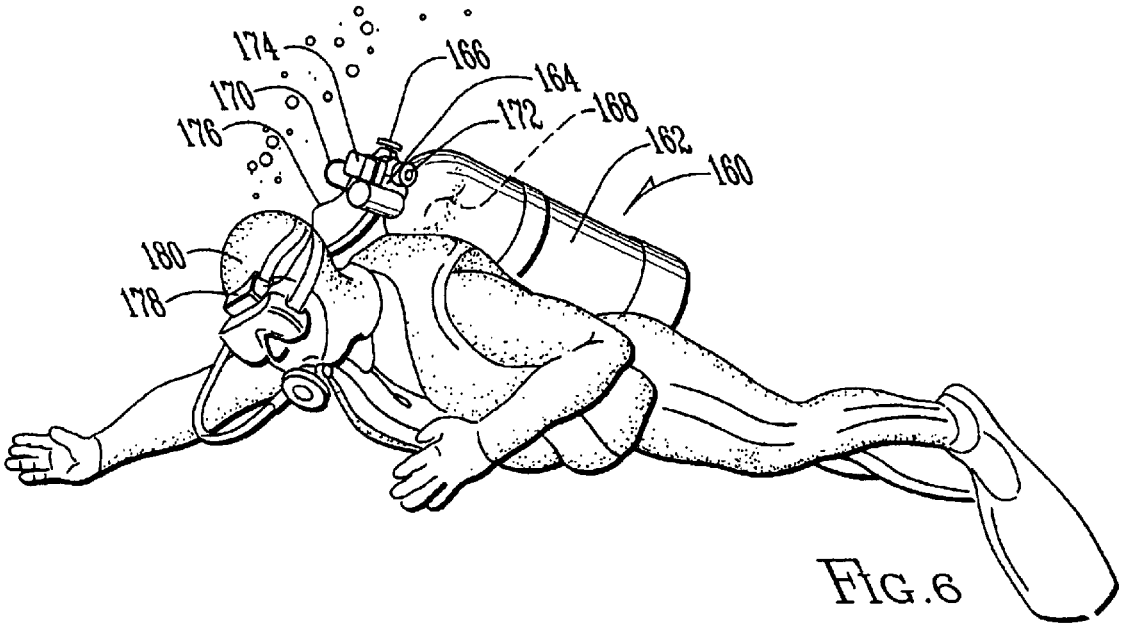
FIG. 6 illustrates a side elevation of a diver and diving gear, utilizing the present invention.

In yet another alternative embodiment of the present invention, FIG. 6 illustrates a self-contained underwater breathing apparatus (scuba diver) (160), coupled to a compressed air tank (162), such as those well known in the art. Coupled directly to the compressed air tank (162) is a vane motor (164), such as that described above. Coupled to the vane motor (164) is a first stage regulator (166), such as those well known in the art to reduce pressures from the compressed air tank (162) on the order of two hundred plus atmospheres to preferably less than ten atmospheres. By running air (168) through the vane motor (164), a percentage of the potential energy of this compressed air (168) can be recovered before being stepped down through the first stage regulator (166). From the first stage regulator (166), the air passes through a line (170) to the second stage regulator (172), which reduces the pressure to approximately one to five atmospheres. As the scuba diver (160) breaths, drawing air (168) from the compressed air tank (162), the air (168) drives the vane motor (164) and the generator (174), which is coupled to the vane motor (164).

The generator (174) may be of any desired construction, but is preferably of the type described above. Coupled to the generator (174) is a wire (176) coupled to a headlight (178), strapped around the head (180) of the scuba diver (160). Although in the preferred embodiment the generator (174) is used to power a headlight (178), the generator (174) may, of course, be used to drive any electrical appliance or may be eliminated if it is desired to utilize the vane motor (164) to generate mechanical work. It should also be noted that the vane motor (164) may be positioned between the first stage regulator (166) and second stage regulator (172), or a plurality of vane motors may be coupled at any desired location to retrieve additional work from the air (168).

An advantage provided by all of the foregoing embodiments, is that the vane motor extracts work from the pressurized fluid (48), while reducing the pressure of the pressurized fluid (48). By performing a portion of the work typically done by a pressure regulator, the assembly (10) of the present invention allows the use of a smaller or more inexpensive pressure regulator to accommodate the lower pressures.

Although the invention has been described with respect to a preferred embodiment thereof, it is also to be understood that it is not to be so limited, since changes and modifications can be made therein which are within the full intended scope of this invention as defined by the appended claims. For example, it should be noted that any desired motor may be used, including a standard turbine or piston motor, and that any type of generator, including both direct current and alternating current generators, may be utilized in accordance with the present invention. It is additionally anticipated that any number of motors and generators may be used in conjunction with any number of regulators to recover work from a pressurized fluid. It is additionally anticipated that the motor and generator may be of any desired dimensions and design, to accommodate any desired pressures.

What is claimed is:

1. A fluid pressure regulator assembly comprising:

(a) a pressurized fluid reservoir;

(b) first means coupled to said reservoir for transporting a pressurized fluid;

(c) second means for transporting a pressurized fluid;

(d) a fluid regulator coupled to said first transporting means and to said second transporting means; and (e) means coupled in fluid communication with said reservoir between said first means and said fluid regulator for converting pressurized fluid into mechanical power.

2. The fluid pressure regulator assembly of claim 1, wherein said mechanical power is rotational motion.

3. The fluid pressure regulator assembly of claim 2, wherein said converting means comprises a plurality of vanes in fluid communication with said reservoir.

4. The fluid pressure regulator assembly of claim 1, wherein said converting means is a vane motor.

5. The fluid pressure regulator assembly of claim 1, further comprising an electrical generator coupled to said converting means.

6. The fluid pressure regulator assembly of claim 1, wherein said converting means is a motor comprising:

(a) an outer race centered about a first axis;

(b) an inner race centered about a second axis;

(c) wherein said first axis is different from said second axis;

(d) wherein said first axis is parallel to said second axis; and (e) a vane coupled for movement relative to said inner race.

7. The fluid pressure regulator assembly of claim 6, further comprising a generator coupled to said motor.

8. The fluid pressure regulator assembly of claim 7, further comprising supplemental means coupled to said first means for converting pressurized fluid into mechanical power.

9. The fluid pressure regulator assembly of claim 8, further comprising means coupled to said fluid regulator for allowing breathing of a fluid passing through the regulator.

10. The fluid pressure regulator assembly of claim 9, further comprising a watertight generator coupled to said converting means.

11. A fluid pressure regulator comprising:

(a) a pressurized fluid reservoir;

(b) a first pressurized fluid line coupled to said reservoir;

(c) means coupled to said first pressurized fluid line in fluid communication with said reservoir for converting pressurized fluid into mechanical energy;

(d) a regulator coupled to said generating means; and (e) a second pressurized fluid line coupled to said regulator.

12. The fluid pressure regulator of claim 11, wherein said converting means comprises a plurality of vanes in fluid communication with said first providing means.

13. The fluid pressure regulator of claim 11, wherein said converting means is a turbine.

14. The fluid pressure regulator of claim 11, further comprising an electrical generator coupled to said converting means.

15. The fluid pressure regulator of claim 11, wherein said converting means is a motor comprising:

(a) an outer race centered about a first axis;

(b) an inner race centered about a second axis;

(c) wherein said first axis is different from said second axis;

(d) wherein said first axis is parallel to said second axis; and (e) a vane coupled for movement relative to said inner race.

16. The fluid pressure regulator of claim 15, further comprising a generator coupled to said motor.

17. A method for converting pressurized fluid into power comprising:

(a) providing a fluid regulator;

(b) providing pressurized fluid to said fluid regulator;

(c) providing a pressurized fluid reservoir; and (d) converting said pressurized fluid directly from said reservoir into mechanical motion prior to said pressurized fluid reaching said fluid regulator.

18. The method for converting pressurized fluid of claim 17, further comprising converting said mechanical motion to electricity.

19. The method for converting pressurized fluid of claim 18, further comprising monitoring said electricity and regulating said mechanical motion sufficiently to produce said electricity at a substantially predetermined rate.

20. The method of converting pressurized fluid of claim 17, wherein said converting means is a vane motor.

* * * * *